US008100375B2

(12) United States Patent
Woodworth

(10) Patent No.: US 8,100,375 B2
(45) Date of Patent: Jan. 24, 2012

(54) MARINE DOCKLINE HOLDER

(76) Inventor: David Charles Woodworth, Zirconia, NC (US)

( * ) Notice: Subject to any disclaimer, the term of this patent is extended or adjusted under 35 U.S.C. 154(b) by 362 days.

(21) Appl. No.: 12/321,992

(22) Filed: Jan. 28, 2009

(65) Prior Publication Data

US 2009/0188418 A1 Jul. 30, 2009

Related U.S. Application Data

(60) Provisional application No. 61/062,999, filed on Jan. 29, 2008.

(51) Int. Cl.
*A47B 91/00* (2006.01)

(52) U.S. Cl. ..... 248/346.03; 114/230.3

(58) Field of Classification Search ..... 248/346.01, 248/346.03, 519, 523, 535, 540, 541, 534; 114/230.1, 230.2, 230.3
See application file for complete search history.

(56) References Cited

U.S. PATENT DOCUMENTS 3,151,595 A * 10/1964 Stainbrook ..... 114/230.25
3,187,707 A * 6/1965 Carbone ..... 114/230.11
3,280,784 A * 10/1966 Stainbrook ..... 114/230.25
4,041,887 A 8/1977 Paul
4,250,827 A * 2/1981 Booker et al. ..... 114/230.18
4,462,329 A 7/1984 Brushaber
4,479,454 A 10/1984 Schepel
4,676,182 A * 6/1987 Chaiko ..... 114/230.25
D313,544 S 1/1991 Scherer
5,036,787 A * 8/1991 Rogers ..... 114/230.19
5,513,592 A * 5/1996 Cotton ..... 114/219
5,520,134 A 5/1996 Walker
5,787,834 A 8/1998 Holland
5,813,163 A * 9/1998 Dysarz ..... 43/21.2
6,123,045 A 9/2000 Prongay
6,168,548 B1 * 1/2001 Fleming ..... 482/23
7,156,357 B1 * 1/2007 Kocur ..... 248/519
7,870,829 B1 * 1/2011 Perry et al. ..... 114/230.1

OTHER PUBLICATIONS

Line Caddy Docksider model described on the web site at www.linecaddy.com/docksid.html with a copyright date of 2000 by LineCaddy Corporation.

* cited by examiner

*Primary Examiner* — A. Joseph Wujciak, III
(74) *Attorney, Agent, or Firm* — Kenneth R. Rice

(57) ABSTRACT

The marine dockline holder provides an easy place to leave the docklines in an elevated position when the boat leaves the dock, enabling the lines to be easily retrieved and attached to the boat upon its return to the dock. The marine dockline holder has a line hook attached to the top of a two-piece rod. The rod is inserted into a spring which is in turn inserted into a deck mounting plate. The deck mounting plate is mounted to a dock by two connecting bolts passing though the upper and lower mounting plates, and though gaps in the dock's surface.

10 Claims, 2 Drawing Sheets

MARINE DOCKLINE HOLDER

CLAIM OF PRIORITY

This application claims priority to provisional patent application 61/062,999 filed Jan. 29, 2008.

BACKGROUND OF THE INVENTION

This invention relates to a marine dockline holder. A dockline is a line used to secure a boat to a dock. When a boat leaves a dock, the docklines are typically left coiled or piled on the dock, or possibly dangling in the water from the dock. When the boat returns to the dock, a crew member has to jump from the moving boat onto the dock to retrieve the docklines and either pass them to another crew member on the boat, or jump back on the boat in order to secure the docklines to the boat. This can be a risky maneuver since docks and boat decks can be wet and slippery.

The marine dockline holder provides an easy place to leave the docklines in an elevated position when the boat leaves the dock, enabling the lines to be easily retrieved and attached to the boat upon its return to the dock. This makes the process of docking the boat much easier and safer for the boaters, eliminating the need to jump from the moving boat onto the dock in order to retrieve the docklines.

DESCRIPTION OF THE PRIOR ART

In the prior art various types of devices have been proposed.

U.S. Pat. No. 3,151,595 to Stainbrook, issued Oct. 6, 1964. Stainbrook shows a dockline holder pivotally mounted on a post which is mounted to the dock. The post has a bayonet type connection to a mounting plate. The dockline holder is telescopely adjustable to multiple lengths.

U.S. Pat. No. 4,041,887 to Paul, issued Aug. 16, 1977. Paul shows a dockline holder which is remotely activated to drop a dockline over a boat mounted cleat.

U.S. Pat. No. 4,462,329 to Brushaber, issued Jul. 31, 1984. Brushaber shows a dockline holder pivotally mounted to a dock piling, with adjustable stops to limit the pivoting of the dockline holder.

U.S. Pat. No. 4,479,454 to Schepel, issued Oct. 30, 1984. Schepel shows a repositionable dockline holder which may be mounted to the dock surface, joist or piling.

U.S. Pat. No. 4,676,182 to Chaiko, issued Jun. 30, 1987. Chaiko shows a flexible dockline holder which may be mounted at multiple angles to the dock.

U.S. Pat. No. D313,544 to Scherer, issued Jan. 8, 1991. Scherer shows a pivoting dockline holder mounted to a piling.

U.S. Pat. No. 5,520,134 to Walker, issued May 28, 1996. Walker shows a fixed dockline holder with reflective tape to increase its visibility.

U.S. Pat. No. 5,787,834 to Holland, issued Aug. 4, 1998. Holland shows a freestanding dockline holder having multiple segments.

U.S. Pat. No. 6,123,045 to Prongay, issued Sep. 26, 2000. Prongay shows a dockline holder with angularly adjustable segments.

Line Caddy Docksider model described on the web site at www.linecaddy.com/docksid.html with a copyright date of 2000 by LineCaddy Corporation. The Line Caddy Docksider model is pivotally mounted to a dock or piling.

SUMMARY OF THE INVENTION

The present invention is directed to a marine dockline holder for use in holding docklines It is an object of the present invention to provide a new and improved marine dockline holder that is simpler in design than previous dockline holders.

It is an object of the present invention to provide a new and improved marine dockline holder that is more flexible and durable than previous dockline holders.

It is an object of the present invention to provide a new and improved marine dockline holder that is built solely from materials impervious to a salt-water environment.

It is an object of the present invention to provide a new and improved marine dockline holder that can be easily adjusted in height to a given situation.

It is an object of the present invention to provide a new and improved marine dockline holder that can easily be removed and relocated to another dock.

It is an object of the present invention to provide a new and improved marine dockline holder that, on most wooden docks, will not require any holes or any other modifications to the dock.

These and other objects and advantages of the present invention will be fully apparent from the following description, when taken in connection with the annexed drawings.

DESCRIPTION OF THE PREFERRED EMBODIMENT

The preferred embodiment herein described is not intended to be exhaustive or to limit the invention to the precise form disclosed. It is chosen and described to best explain the invention so that others, skilled in the art to which the invention pertains, might utilize its teachings.

Figure 1:
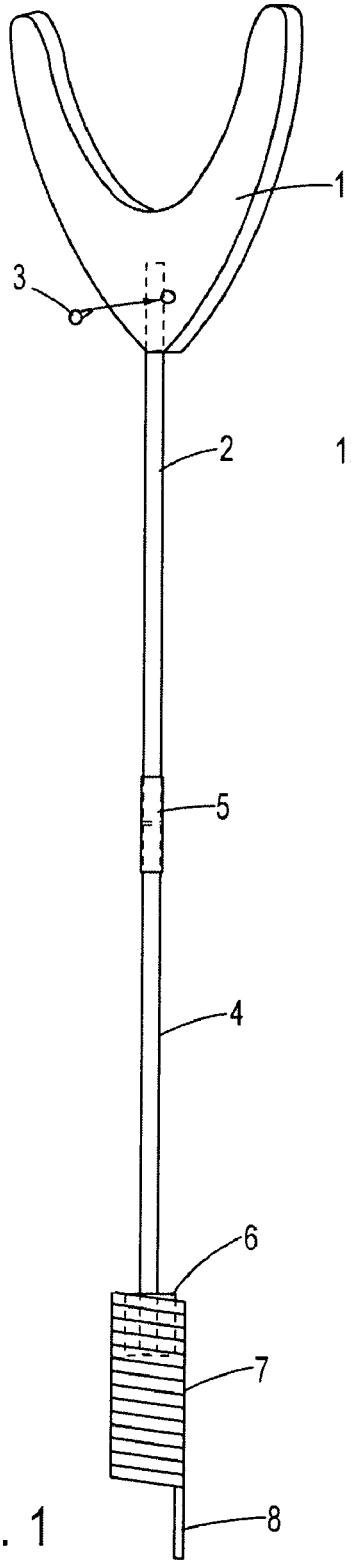
FIG. 1 is a side view of the main dockline holder assembly.

Referring now to the drawings in greater detail, FIG. 1 shows a side view of the main dockline holder assembly. A line hook 1 sits atop and receives the upper rod 2, and is secured to the rod with a small retaining screw 3. The upper rod 2 is connected to the lower rod 4 by a coupling 5. The coupling 5 is made of a thin-walled stainless steel tube whose inside diameter matches the outside diameter of rods 2 and 4, and is crimped to both rods. One end of the coupling is crimped during manufacture, and the second end is crimped during assembly. This will prevent the rod from accidentally separating during use. This allows the rod to consist of two pieces instead of one long piece, facilitating packaging and shipping. The lower end of the lower rod 4 is friction fit into a hole in a spring plug 6. The spring plug 6 in turn is force-fit into the top end of a spring 7. The straight end 8 of spring 7 fits into one of three holes in the top plate of the dock attachment assembly shown in FIG. 2.

Figure 2:
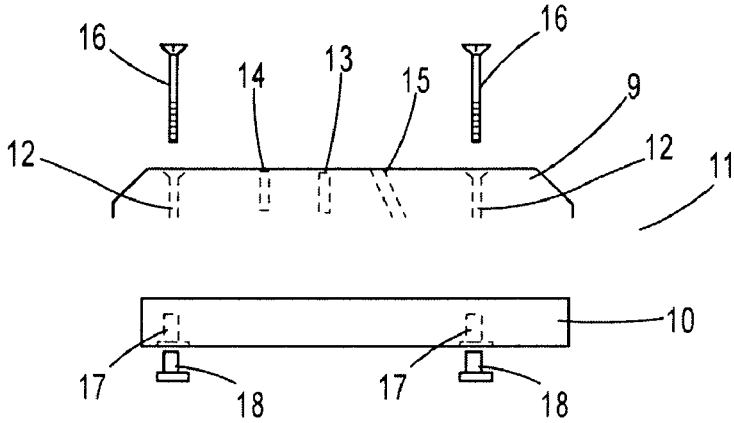
FIG. 2 is a side view of the dock attachment assembly.

FIG. 2 shows a side view of the dock attachment assembly. The dock attachment assembly consists of a top plate 9 and a bottom plate 10. The top plate 9 is chamfered to minimize hazards to bare feet as it sits atop the existing dock 11. The top plate 9 has five holes 12-15 lengthwise down the centerline.

Holes 12 are for two connecting bolts 16 which are connected to the lower plate 10. Holes 13, 14 and 15 receive the straight end 8 of spring 7. The center hole 13 is perpendicular to the surface of the top plate 9, while holes 14 and 15 are set at ten degrees from the top surface of the top plate 9. Hole 14 is set at ten degrees laterally of the top plate 9. Hole 15 is set at ten degrees lengthwise of the top plate 9. The lower plate 10 has two holes 17 lining up with the holes 12 in top plate 9. The holes 17 in the lower plate 10 are counter bored to receive stainless steel T-nuts 18. Bolts 16 are long enough to reach through normal dock boards 11 of either 1½" or 1¼" thickness, and are intended to fit in the space gap normally left between the boards. Thus no holes normally need be drilled in most wooden docks to attach the holder.

Figure 3:
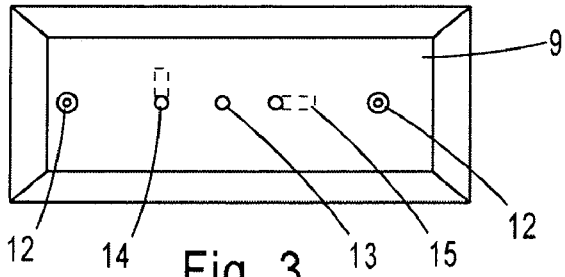
FIG. 3 is a top view of the top plate of the dock attachment assembly.

FIG. 3 is a top view of the top plate 9, showing the two countersunk holes 12 for bolts 16 on either end, plus the three holes 13, 14, 15 in the center to receive spring 7. It also shows the chamfered edges of the top plate 9.

Figure 4:
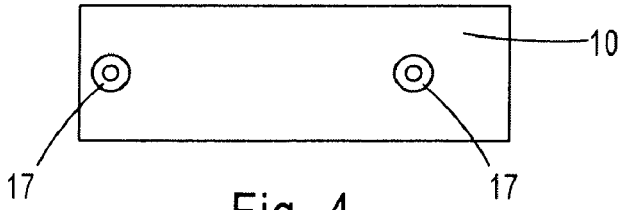
FIG. 4 is a bottom view of the bottom plate of the dock attachment assembly.

FIG. 4 is a bottom view of the bottom plate 10 showing the counter bored holes 17 for T-nuts 18. It also shows the asymmetrical nature of the bottom plate 10 which allows the top plate 9 to sit closer to the edge of the dock 11 should there be any boards on the underside of the dock 11 near the edge.

Line hook 1, top plate 9 and bottom plate 10 are preferably all made of ¾" white HDPE, or high-density polyethylene. Spring plug 6 is preferably made of ¾" diameter white HDPE. All metal parts, including screw 3, coupling 5, spring 7, bolts 16 and T-nuts 18, are preferably made of 316 stainless steel. Rods 2 and 4 are preferably made of 0.305" diameter solid fiberglass rod or similar material.

Operation

In operation, two to four dockline holders may be needed to secure all the docklines, depending on the size of the boat and how many docklines are used to secure it. The dockline holder works equally well for boats brought into the slip bow first or stern first, or for boats docked side to the dock.

Figure 5:
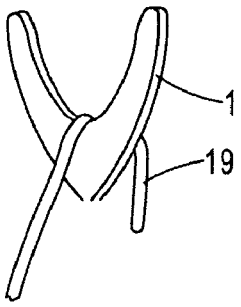
FIG. 5 shows a dockline draped over the inside of the line hook.
Figure 6:
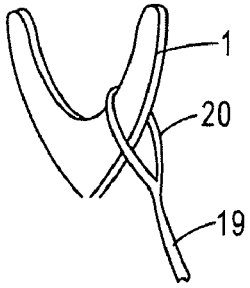
FIG. 6 shows the eye of a dockline placed over one of the arms of the dockline hook.

FIG. 5 shows a dockline 19 draped over the inside of line hook 1, which can be done using any dockline, either with an eye 20 spliced into the end or without an eye. FIG. 6 shows the eye 20 of dockline 19 placed over one of the arms of the dockline hook 1.

Figure 7:
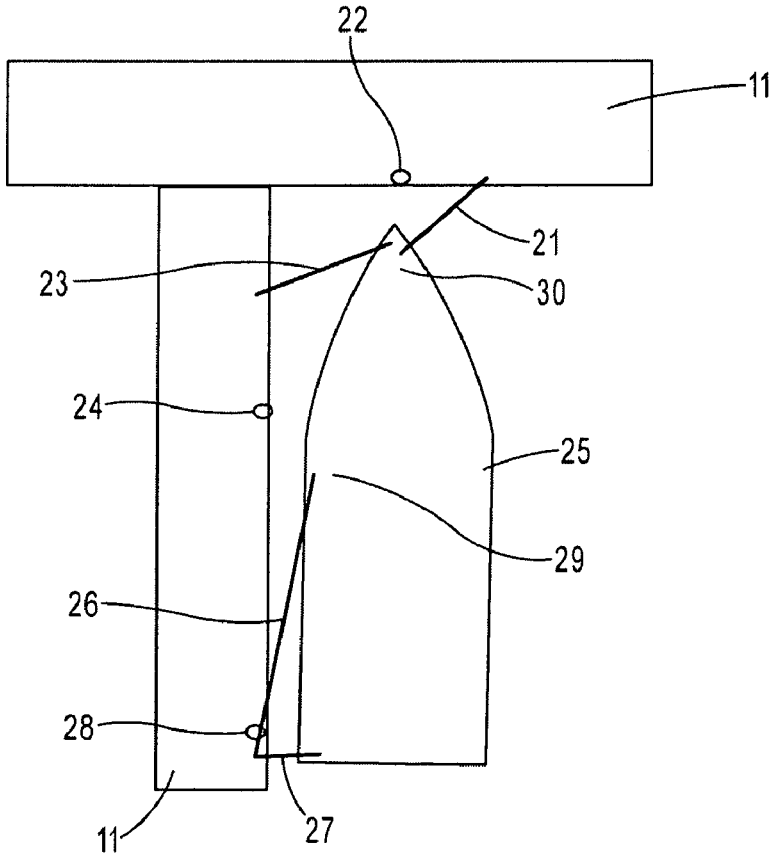
FIG. 7 shows a sample docking arrangement.

As the boater prepares to leave the dock 11, each dockline is placed in the appropriate dockline holder. FIG. 7 shows a sample docking arrangement. In this case, bow dockline 21 would first be placed in dockline holder 22, which would be angled out from the dock 11 using one of the appropriate ten degree angled holes 14, 15 in top plate 9. Bow dockline 23 would then be placed in dockline holder 24, which would also be angled out from the dock 11. The final step before backing the boat 25 out of the slip would be to place spring dockline 26 and stern dockline 27 in dockline holder 28, which would probably be vertical in order not to interfere with the boat 25 as it passes the dockline holder 28.

On returning to the dock 11, spring line 26 would be retrieved first as the boat 25 passes dockline holder 28, and secured to a cleat 29 located amidships. As the boat 25 moves further into the slip, bow line 23 would be retrieved from dockline holder 24 and secured to the bow 30 of the boat 25. Spring line 26 will serve to halt the motion of the boat 25 into the dock 11 or slip at the appropriate place within the slip, while attention is paid to securing the remaining bow 21 and stern 27 docklines. Docklines 21, 27 would then be retrieved from dockline holders 22, 28 and secured to the boat 25. All of this is done from the safety of the deck of the boat 25, precluding the need for any crew members to leap from the moving boat 25 onto the potentially slippery and/or unstable dock 11.

Spring 7 allows the upper part of the dockline holders 22, 24, 28 to swing down and out of the way with no damage to either boat 25 or dockline holders 22, 24, 28 should the holder encounter some part of the moving boat 25 as it enters or departs the dock 11. The line hook 1 is specifically designed with no sharp corners or areas that might snag lifelines or other parts of the boat.

Either or both rods 2, 4 can be easily cut by the owner by any kind of saw to accommodate any sized boat 25, placing the line hook 1 at the proper height so as to be easily retrieved from the deck of the boat 25.

Alternative Embodiments

All parts could be made using different materials or different sizes, within reason, with little effect on the overall function of the dockline holder.

The shape of line hook 1 can be varied over a broad range with no adverse affect on the functionality of the invention.

Spring 7 can be eliminated from the invention, and larger holes drilled in top plate 9 to accommodate the bottom of the lower rod 4. This introduces the possibility that the lower rod 4 could bend and break at the base if the moving boat 25 moved into the dockline holder, but otherwise the invention would function as designed.

Upper rod 2 and lower rod 4 could be combined into a single longer rod with no deleterious effects on the operation of the dockline holder. The coupling 5 and the shorter rods 2, 4 are simply to facilitate packaging and shipping.

The bottom plate 10 can be discarded and top plate 9 can be screwed or bolted directly to any surface not lending itself to the illustrated design. Using owner-supplied fasteners, it could be mounted to a solid wood dock, to a concrete dock, or to a retaining wall.

Although the marine dockline holder and the method of using the same according to the present invention has been described in the foregoing specification with considerable detail, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A dockline holder comprising a base configured to be removably attached to a dock, a rod connected to the base, and a hook connected to the rod on the end opposite the base, wherein the base has at least one hole to provide a connection for the rod, wherein the connection for the rod is a spring which is connected to the base, and the rod is connected to the spring, and wherein a plug is inserted into the end of the spring, and the rod is connected to the plug, wherein at least three holes are provided in the base for connection to the rod, one of the holes being perpendicular to the surface of the base, a second hole being inclined at approximately 10 degrees from perpendicular to the surface of the base, and a third hole being inclined at approximately 10 degrees from perpendicular to the surface of the base in a direction approximately 90 degrees from the direction of inclination of the second hole.

2. The dockline holder as claimed in claim 1, wherein the base is comprised of an upper part and a lower part, the upper part being placed on the top side of the dock, the lower part being placed beneath the dock, and connection means passing though the dock to connect the upper part to the lower part.

3. The dockline holder as claimed in claim 2, wherein the connection means is at least one bolt which passes through at least one hole in the upper part of the base, though the dock, and though as least one hole in the lower part of the base, and at least one nut connected to the bolt to clamp the upper part, the lower part and the dock together.

4. The dockline holder as claimed in claim 3, wherein the at least one nut is a T-nut inserted into the at least one hole in the lower part of the base.

5. The dockline holder as claimed in claim 3, wherein at least two holes are provided in the upper and lower parts of the base, the holes being asymmetrically positioned on the upper and lower parts of the base.

6. The dockline holder as claimed in claim 1, wherein the spring has a straight end which is inserted into the at least one hole in the base.

7. The dockline holder as claimed in claim 1, wherein the rod is formed of at least two parts, the at least two parts being joined by a connector.

8. The dockline holder as claimed in claim 7, wherein the connector is crimped to the at least two parts, one of the crimped connections being made during assembly by an end user.

9. The dockline holder as claimed in claim 1, wherein the hook is provided with two arms extending from the center of the hook, the center of the hook being connected to the rod.

10. A dockline holder comprising: a base comprised of an upper part and a lower part, the upper part being placed on the top side of a dock, the lower part being placed beneath the dock, connecting means comprising at least two bolts which pass through at least two holes in the upper part of the base, though the dock, and though as least two holes in the lower part of the base, a T-nut inserted into each hole in the lower part of the base and connected to the bolts to clamp the upper part, the lower part and the dock together, the at least two holes being asymmetrically positioned on the upper and lower parts of the base, at least three holes being provided in the base for connection to a rod, one of the holes being perpendicular to the surface of the base, a second hole being inclined at approximately 10 degrees from perpendicular to the surface of the base, and a third hole being inclined at approximately 10 degrees from perpendicular to the surface of the base in a direction approximately 90 degrees from the direction of inclination of the second hole, a spring with a straight end which is inserted into one of the holes in the base, a plug inserted into the end of the spring, and the rod connected to the plug, the rod being formed of at least two parts, the at least two parts being joined by a connector which is crimped to the at least two parts of the rod, one of the crimped connections being made during assembly by an end user, a hook which is provided with two arms extending from the center of the hook, the center of the hook being connected to the rod.

* * * * *